US007270071B1

(12) United States Patent
Shivers, III et al.

(10) Patent No.: US 7,270,071 B1
(45) Date of Patent: Sep. 18, 2007

(54) DEEP DRAFT SEMISUBMERSIBLE MOVABLE OFFSHORE STRUCTURE

(75) Inventors: Robert M. Shivers, III, Houston, TX (US); William T. Bennett, Jr., Houston, TX (US); David Trent, Cypress, TX (US)

(73) Assignee: ATP Oil & Gas Corporation, Houston, TX (US)

( * ) Notice: Subject to any disclaimer, the term of this patent is extended or adjusted under 35 U.S.C. 154(b) by 0 days.

(21) Appl. No.: 11/694,708

(22) Filed: Mar. 30, 2007

(51) Int. Cl.
*B63B 35/44* (2006.01)

(52) U.S. Cl. ..... 114/265; 405/195.1

(58) Field of Classification Search ..... 114/265; 405/195.1, 223
See application file for complete search history.

(56) References Cited

U.S. PATENT DOCUMENTS 4,168,673 A * 9/1979 Poeppel ..... 114/265
4,169,424 A * 10/1979 Newby et al. ..... 114/265
4,864,958 A * 9/1989 Belinsky ..... 114/265
5,551,803 A 9/1996 Pallini, Jr. et al.
6,190,089 B1 2/2001 Bennet, Jr. et al.
6,447,208 B1 * 9/2002 Huang et al. ..... 405/224
7,008,340 B2 3/2006 William et al.
7,011,472 B2 * 3/2006 Martensson et al. ..... 405/205
7,112,011 B2 9/2006 McCarty et al.
7,131,922 B2 11/2006 Williams et al.

* cited by examiner

*Primary Examiner*—Stephen Avila
(74) *Attorney, Agent, or Firm*—Buskop Law Group, PC; Wendy Buskop

(57) ABSTRACT

The present invention is a deep draft partially submersible and buoyant floating vessel comprised of at least three independent vertical columns. The columns have an upper column with an upper column diameter and a lower column integrally connected to the upper column with a lower column diameter smaller than the upper column diameters. The lower column contains a variable ballast, a free flooding ballast, and a lower column fixed ballast. The lower pontoon is connected to each lower column opposite the upper column. The lower pontoon has lower pontoon fixed ballast means. A deck is located on the columns for supporting a tensioner assembly.

15 Claims, 14 Drawing Sheets

DEEP DRAFT SEMISUBMERSIBLE MOVABLE OFFSHORE STRUCTURE

FIELD

The present embodiments relate generally to a moveable, towable, submersible floating offshore vessel suitable for use in deep waters for supporting, oil and gas drilling, production, and workover operations.

BACKGROUND

Many types of structures exist for oil and gas exploration, however few exist that can perform drilling and production operations and be moveable. Still fewer structures can perform drilling, production, and workover operations in deep waters, far from shore.

A need has existed for an improved, versatile vessel that can be used for demanding drilling operations in deep waters, yet be a floating vessel that can be towed from site to site for work.

Additionally, a need has existed for a vessel that is transparent to the motion of the waves about the lower portions of the rig, while having a center of gravity below the center of buoyancy to reduce the effects of heave and roll motion during use.

A need has existed for a rig that can additionally reduce the effects of pitch, yaw, and sway on risers connected to the rig.

The present invention contemplates reducing or eliminating many of the drawbacks associated with other conventional deep water rigs, and providing a mobile, stable rig, having superior motion characteristics and reduced response to wind and wave forces.

SUMMARY OF THE INVENTION

It is therefore, an object of the present invention to provide a deep draft partially submersible and buoyant offshore rig with inherent absolute stability and minimum movement, that not only has reduced heave and roll motion to affect risers connected to it from the sea floor, but equipment to significantly reduce yaw, roll, and sway on risers coming from a subsea well at a large water depth, such as 5000 feet, 8000 feet or even 10,000 feet.

It is another object of the present invention to provide a deep water partially submersible and buoyant vessel for offshore drilling and production operations that can be towed from a first site to a second site.

These and other objects of the invention are achieved through a provision of a deep draft partially submersible and buoyant offshore rig for conducting offshore operations, such as drilling, production, workover, or thermal energy recovery operations.

The invention is a deep draft partially submersible and buoyant floating vessel that entails at least three independent vertical columns. Each of the columns has an upper column with an upper column diameter and an upper column variable ballast means. Each column has a lower column with a lower column diameter that is smaller than the upper column diameter.

Each lower columns is integrally connected to each upper column. The lower columns have a lower column diameter, a lower column variable ballast means, a free flooding ballast means and a lower column fixed ballast means.

A lower pontoon is connected to each lower column opposite the upper column. The lower pontoon has fixed ballast means.

At least one deck is secured to the top portions of the columns, which portion is termed the "upper hull". The deck is suitable for conducting afloat operations.

The columns are spaced from each other to provide wave transparency and afloat stability for damping wave induced motions of the vessel and all of the ballast means accommodating eccentricities acting on the deck and/or operational loads so as to prevent mutual load transfer between the columns. A plurality of horizontal braces can be used to prevent mutual load transfer.

Within the columns are means for reinforcing the columns mounted about an inner circumference of each of the columns. A ring frame with a plurality of vertical stiffeners is also secured to the inner circumference of each column.

A tensioner assembly is secured on a riser support structure of the vessel and positioned within the plurality of columns to isolate the effects of roll and sway on the risers connected with the sea floor.

Bracing members are fixedly connected to each column and to the tensioner assembly. Some of the bracing members are located at a plurality of spaced vertical locations along the length of the columns. The bracing members are used to reduce water plane inertia to said vessel and to provide stability of the vessel deployed at an offshore location.

The vessel has a center of gravity below a center of buoyancy.

BRIEF DESCRIPTION OF THE DRAWINGS

The detailed description will be better understood in conjunction with the accompanying drawings as follows.

The present embodiments are detailed below with reference to the listed Figures.

DETAILED DESCRIPTION OF THE EMBODIMENTS

Figure 1:
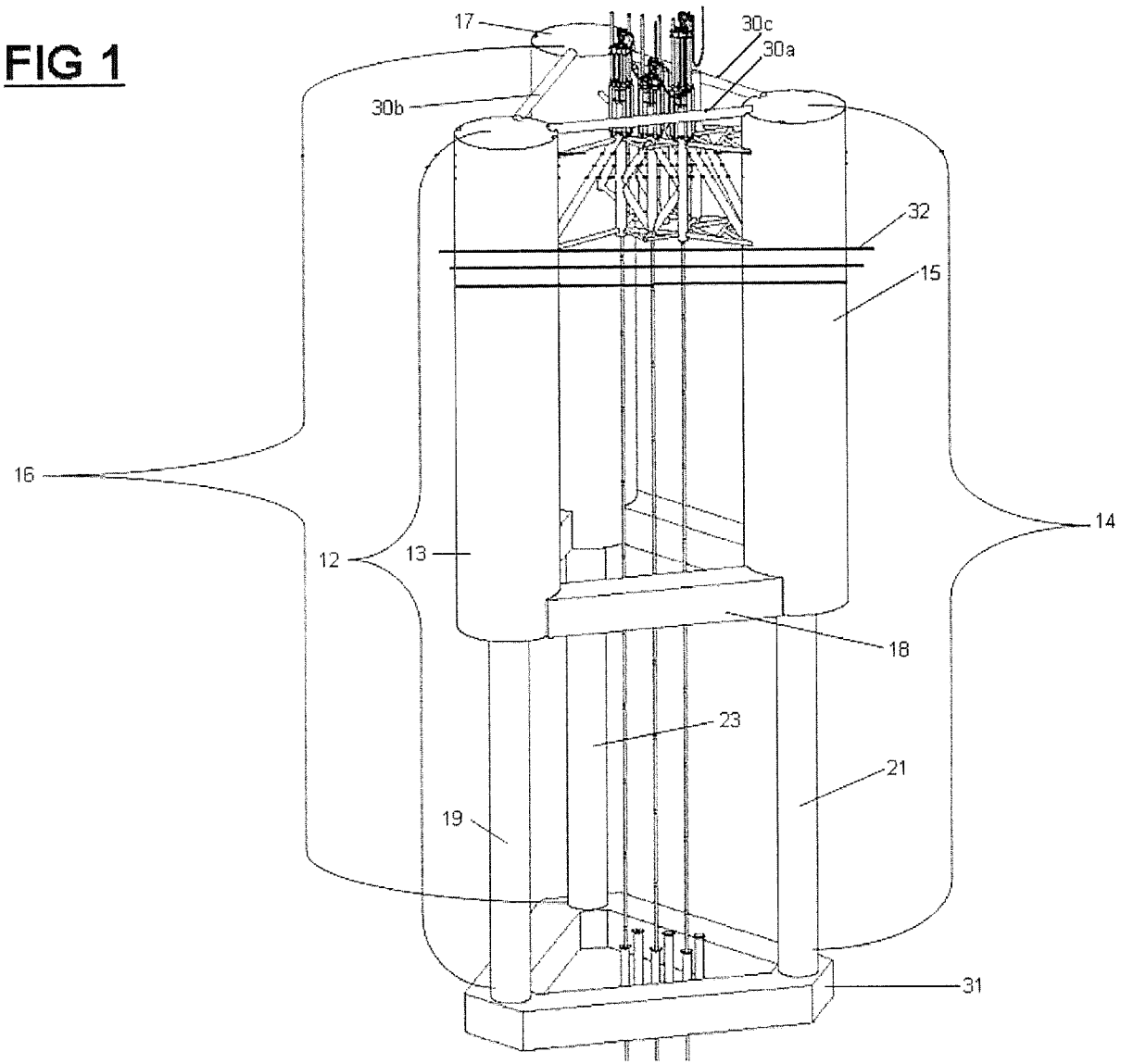
FIG. 1 depicts a portion of the rig, showing the three columns connected together.

Referring now to FIG. 1, FIG. 1 depicts a portion of an embodiment of the offshore rig in accordance with the present invention, hereafter termed the "rig."

The rig of this depicted embodiment is made of three columns, 12, 14, and 16 spaced geometrically in a triangular configuration.

It is contemplated that more than three columns can be used, such as four columns geometrically spaced in a square or rectangular configuration, eight columns spaced in an octagonal configuration, or other numbers of columns and configurations. The columns 12, 14, and 16 are connected together, forming a central hole 18 over which a tensioner assembly 20, shown in FIG. 2, can be positioned for holding risers from the sea floor.

The columns 12, 14 and 16 are submerged below the water surface 32 to a depth sufficient to remove the influence of surface waves.

In an embodiment, it is contemplated that the submerged portion of each column would occupy between 30% and 80% of the length of the columns 12, 14, and 16.

Each column can provide buoyancy to the overall rig so as to support the rig against well above the level of maximum expected wave motion in a 100 year storm, or above any effect that waves due to loop currents might produce.

Figure 2:
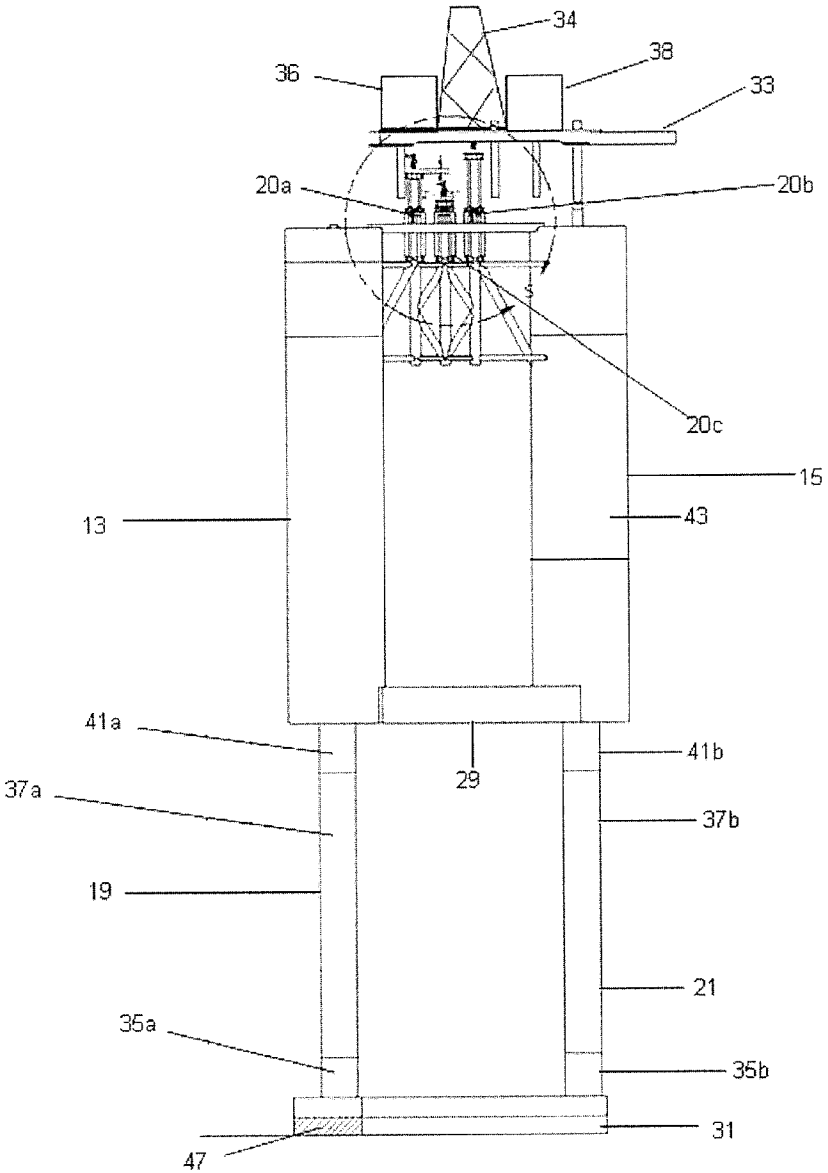
FIG. 2 is side view of the rig.
Figure 2A:
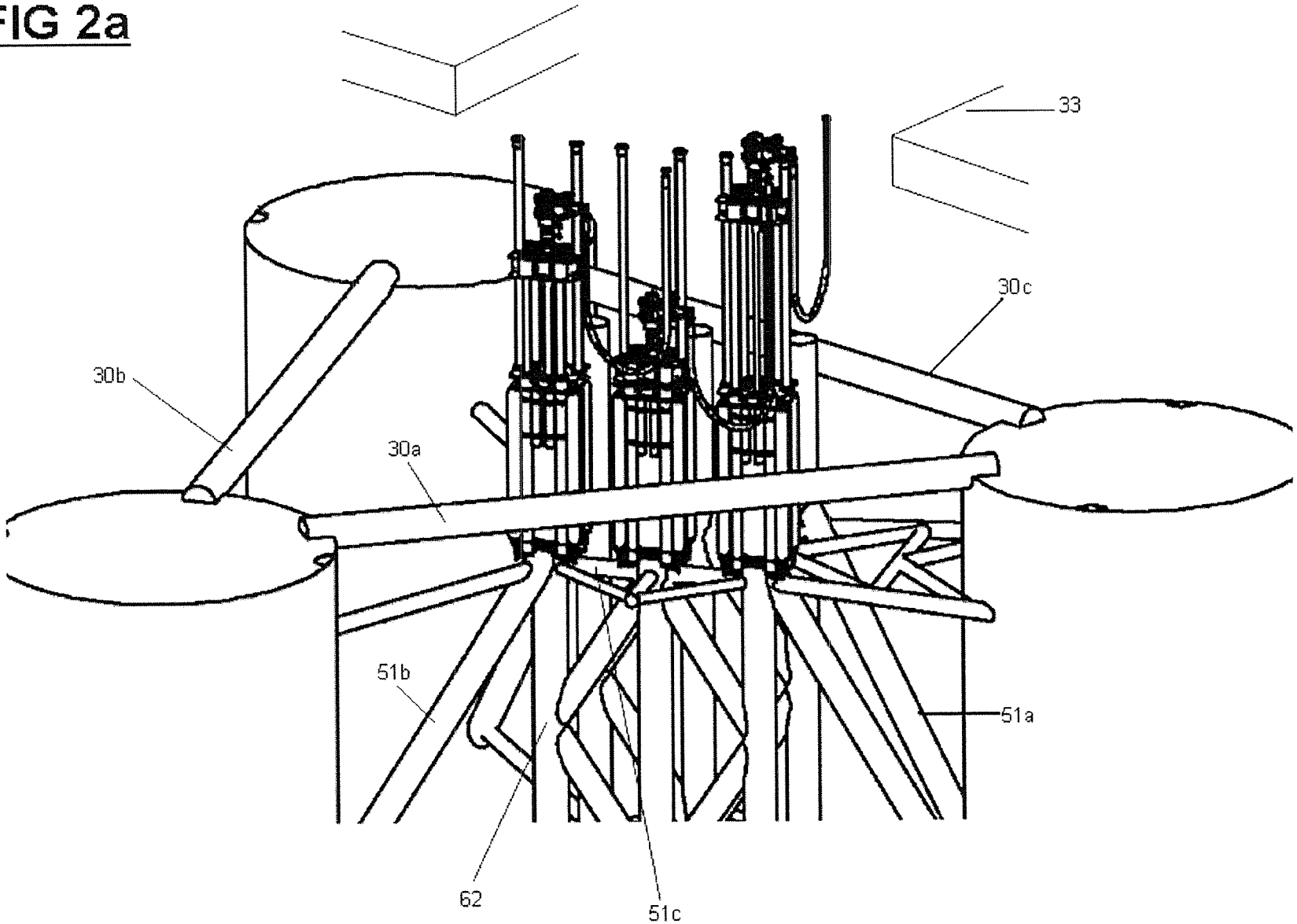
FIG. 2*a* is a perspective view of a tensioner assembly installed on a conductor for a rig.

Each column is formed from an upper column 13, 15, and 17 which has a diameter larger than the integrally connected lower column 19, 21, and 23. A deck 33, shown in FIG. 2 and FIG. 2*a*, is secured to a conductor 62, shown in FIG. 2*a*. As shown in FIG. 2*a*, a tensioner assembly 20 is secured to structural bracing 51*a*, 51*b* and 51*c* and is proximate to the deck 33. The tensioner assembly 20 can be located over or under the deck 33. The structural bracing 51*a*, 51*b*, and 51*c* acts as a riser support structure, which can be tubular structures supporting the riser and connecting to the upper columns at elevations between 465 and 420 feet.

The upper columns 13, 15, and 17 are connected by horizontal braces 30*a*, 30*b*, and 30*c*.

At the bottom of the columns 12, 14, and 16, connecting all of the columns 12, 14, and 16 is a lower pontoon 31.

FIG. 2 depicts a side view of an embodiment of the rig, wherein the rig can be used as a drilling or production facility with three tensioner assemblies 20*a*, 20*b*, and 20*c*, a deck 33, a conventional derrick 34, living quarters 36, and a control room 38.

If desired, additional facilities can be mounted to the deck 33, such as drilling facilities or production facilities. The rig can be used for thermal energy recovery or other operations in deep ocean waters. Regardless of the intended purpose of the rig, the depicted design provides a statically stable rig with minimum movement.

An important feature of the rig is that its center of gravity is below its center of buoyancy, in contrast to conventional floating moored rigs. Due to this characteristic, the rig possesses inherent absolute stability and is capable of supporting over-water operations for many applications while resisting heave and roll motions.

Additionally through use of the tensioner assemblies 20*a*, 20*b*, and 20*c*, the effects of pitch, yaw, and sway are minimized on risers connected to the vessel.

To ensure that the center of gravity of the rig is below its center of buoyancy, permanent ballast, variable ballast, interchangeable ballast means are used in each of the columns 12, 14, and 16.

The lower pontoon 31 is depicted connected to the bottom of each of the columns. Lower pontoon fixed ballast 47, which can be concrete, can be contained in the lower pontoon 31.

FIG. 2 shows column upper column 13 and lower column 19, which together form column 12, depicted in FIG. 1. The diameter of the upper column 19 is larger than the diameter of the lower column 13. Upper column 15 and lower column 21 together form column 14, depicted in FIG. 1. The diameter of upper column 15 is larger than that of lower column 21.

For example, a rig having three columns could have an overall length of about 600 feet, while the diameter of each the upper column could be 50 feet, and the diameter of each lower column could be 25 feet.

Lower column fixed ballast 35*a* and 35*b* can be the same fixed ballast as in the lower pontoon 31. Each fixed ballast can be a heavy, solid material, such as anchor chain, steel scrap, concrete, or other materials, liquid or solid. Upper columns 13 and 15 are connected by lower pontoon 29.

Free flooding ballast 37*a* and 37*b* is located in the lower columns 19 and 21.

It is contemplated that the rig can be towable and movable from the vertical position.

First variable ballast 41*a* and 41*b* facilitates relocation of the rig, when necessary, as it could be removed in part to assist in raising the rig, such as when the rig must be higher in the water to facilitate towing.

The inherent absolute stability of the rig makes it more resistant to wind or other overturning moments, which is an advantage of this design having various types of ballast for each column, and the fixed ballast in the lower pontoon.

Second variable ballast 43 is contained in each upper column and can be a controllable water ballast for stabilizing the vessel based on load changes on the deck 33.

Referring to FIG. 2*a*, the columns are shown interconnected by a plurality of horizontal braces 30*a*, 30*b*, 30*c*, which are spaced about the vertical length of the columns. None of the horizontal braces 30*a*, 30*b*, or 30*c* pierce the water surface.

Horizontal braces 30*a*, 30*b*, and 30*c* can be connected together to maintain the special relationship of the columns.

Figure 3A:
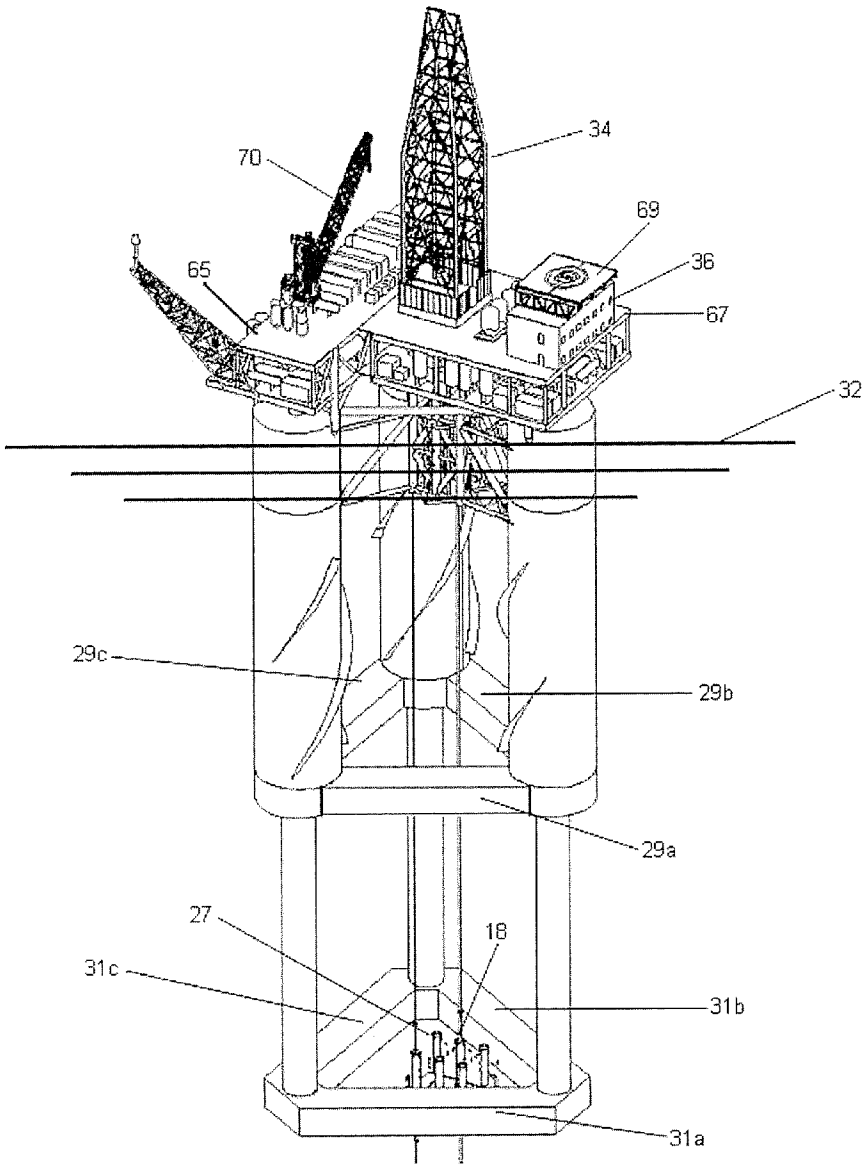
FIG. 3*a* is a perspective view of the rig.

Referring now to FIG. 3*a*, which is a perspective view of the rig, a production module 65 is shown containing production equipment and spanning between two columns. A utility module 67 is shown containing wells and helideck 69 and a crane 70 spanning between the remaining column to the center of the production module 65.

The three lower pontoons 31*a*, 31*b*, and 31*c* are connected together with a non buoyant plate 27 forming a lower raft disposed in central hole 18. The non-buoyant plate 27 is preferably made from stiffened steel, that can vary in thickness depending on the load supported. The thickness can range from 0.5 to 4 inches, filling in the opening between the columns. The non buoyant plate 27 connects the lower pontoons 31*a*, 31*b*, and 31*c* with riser guides at elevations of zero feet. The lower pontoons can be 24 feet wide by 20 feet tall and connect the lower columns between elevations of zero feet and 20 feet. Three upper pontoons 29*a*, 29*b*, and 29*c* connect the columns. The upper pontoons can be 24 feet wide by 20 feet tall and connect to the upper columns at elevations between 220 and 240 feet.

Figure 3B:
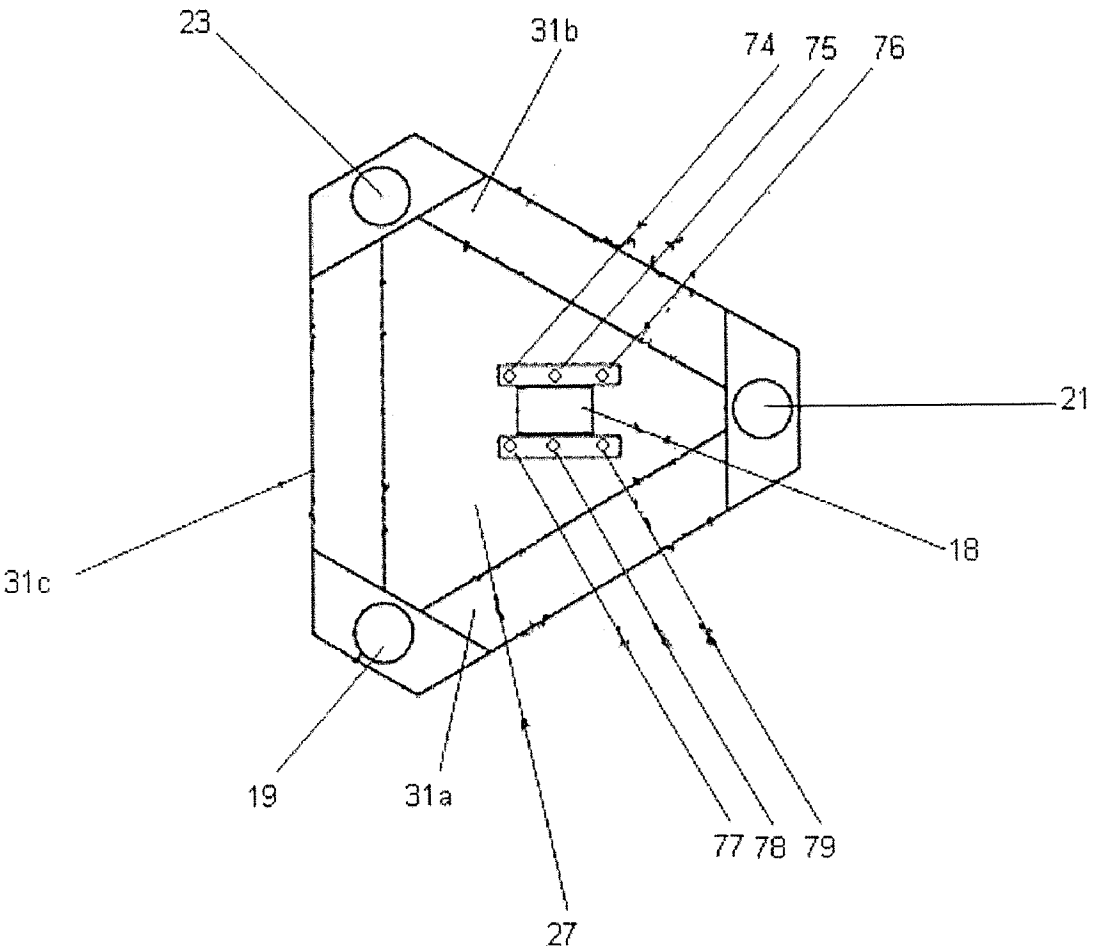
FIG. 3*b* is a bottom view of the non buoyant plate connected to the lower pontoons.

FIG. 3*b* shows a plan view of the non buoyant plate 27. The center hole 18 is depicted with a plurality of riser guides. FIG. 3*b* depicts riser guides 74, 75, 76, 77, 78, 79.

FIG. 3*b* also depicts lower pontoons 31*a*, 31*b*, 31*c* and lower columns 19, 21 and 23.

Figure 3C:
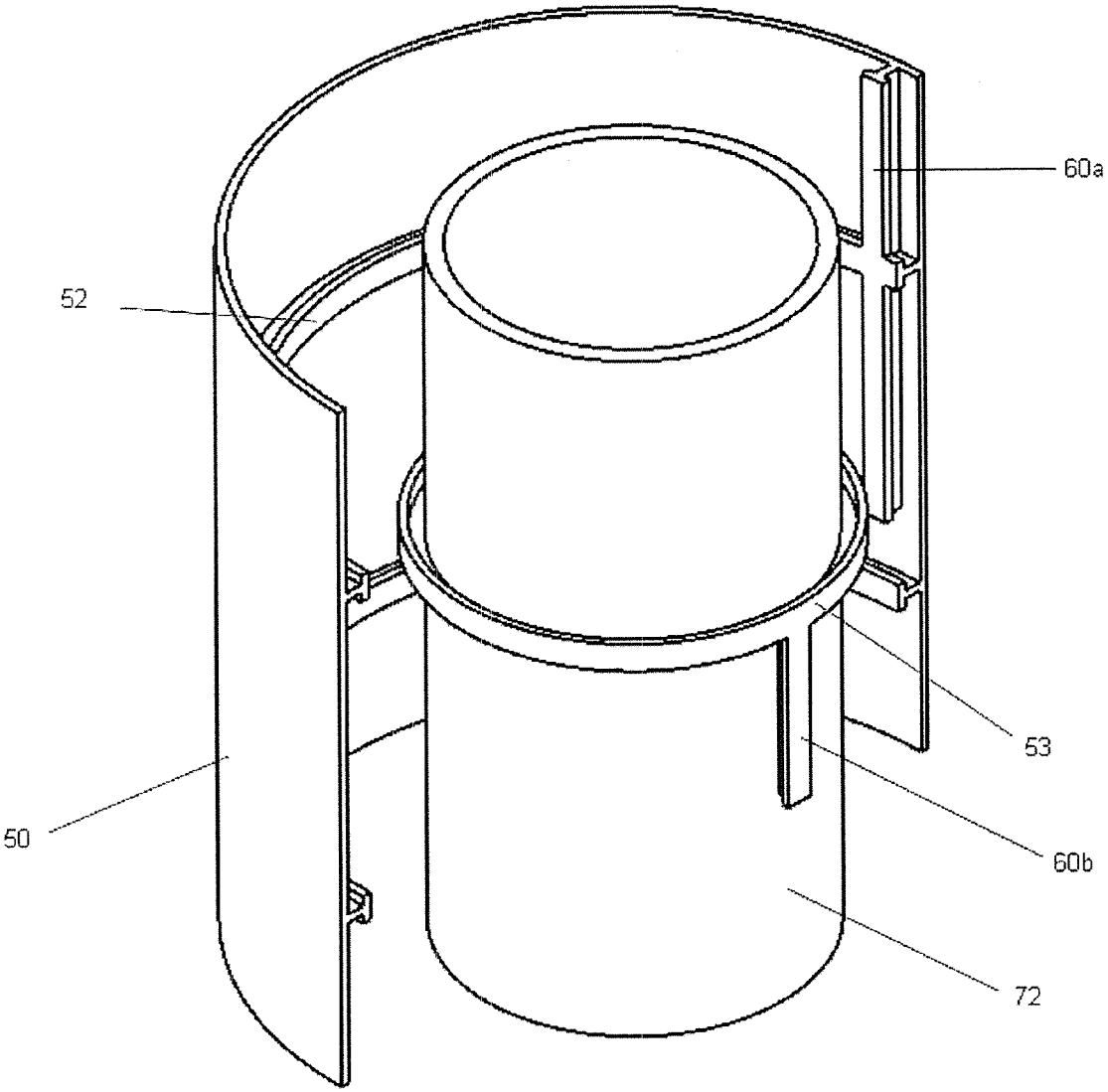
FIG. 3*c* a cut away view showing access trunk of the column.

FIG. 3*c* shows an access trunk 72 for each of the upper columns, which is a region interior to the upper columns, such as a 20 foot diameter, extending from an elevation of 0 feet to an elevation 220 feet.

FIG. 3*c* also shows a plurality of vertical stiffeners 60*a* and 60*b* secured, such as by welding, to the interior of the outer shell 50. Vertical stiffeners 60*a* and 60*b* are shown welded to the interior of the outer shell 50 and to ring frames 52 and 53, respectively, in a side-to-side arrangement.

In a contemplated embodiment, the rig can be moored by a flexible catenary means, such as two or more mooring lines, which can be chain, wire, or a combination of chain and wire. It is also possible to provide a taut mooring system with metal fairleads and nylon bushings.

It is particularly contemplated that this rig design can be moored with a 12-point mooring system, wherein two lines could break, and the rig could still remain safely moored. Each column can support up to six mooring fairleads.

The mooring lines can be connected to conventional anchors moored in the sea floor (not shown), bearing in mind that the rig is designed to operate in water depths of between 1,000 ft. to 10,000 ft.

A plurality of mooring lines can form a flexible catenary means, and can be deployed and retrieved when the rig needs to be removed from one location and transferred to another location. As a result, the rig possess the advantage of easy mobility between locations. The cost savings afforded by complete retrieval of the components of the rig also increase the cost effectiveness of the unit.

Each column can be spaced equidistantly from adjacent columns. In the illustrated embodiments, the rig has three columns arranged in a generally triangular configuration.

The areas between the columns are transparent to wave action, which in turn reduce the loading on the overall rig.

By maintaining a spaced relationship between the columns, water plane inertia is increased, thereby improving stability of the rig, making it more resistant to rolling and pitching, and providing more stability to the riser.

Figure 3D:
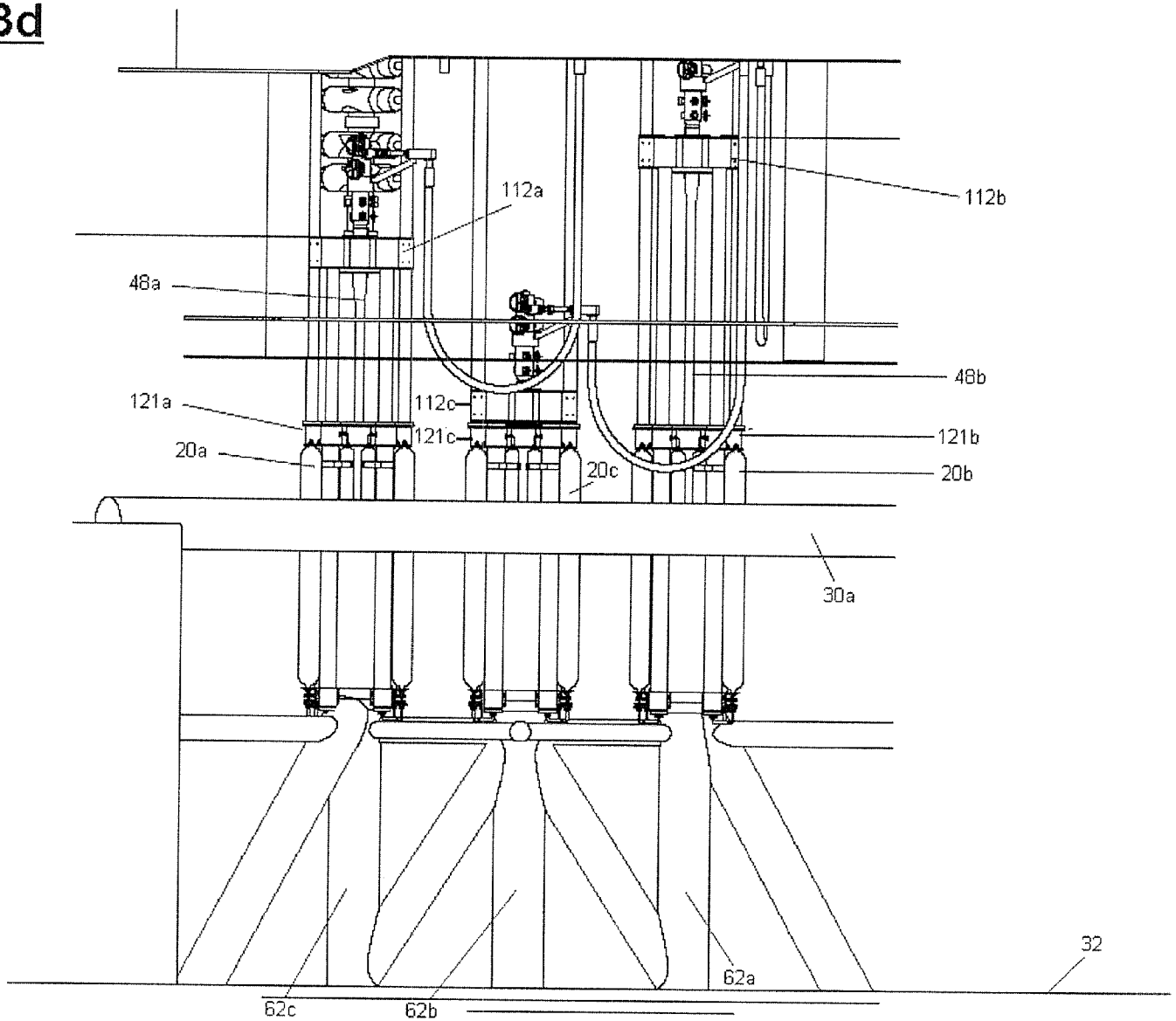
FIG. 3*d* is close up side view of a three tensioner assembly portion of a rig.

FIG. 3*d* depicts risers 48*a* and 48*b* in an embodiment showing three tensioner assemblies 20*a*, 20*b*, and 20*c*. Tensioner assemblies 20*a*, 20*b*, and 20*c* have cylinder decks 121 *a*, 121*b*, and 121*c*, respectively. Tensioner assemblies 20*a*, 20*b*, and 20*c* have tension disks 112 *a*, 112*b*, and 112*c*, respectively. Tensioner assemblies 20*a*, 20*b*, and 20*c* are connected to conductors 62*c*, 62*a*, and 62*b* respectively, which are disposed toward waterline 32.

Horizontal braces 30*a*, 30*b*, 30*c* (30*b* and 30*c* shown in FIG. 2*a*) interconnect the vertical columns, however the rig is still capable of moving substantially freely in a horizontal direction, as well as a vertical direction. Additionally, due to the ballast in the lower columns, the pitch and roll motions are reduced.

The rig will be subjected to the same forces and overturning moments as those acting on individual columns. The combined submerged rig, however, provides significant inertia to resist roll and heave in response to surface wave forces.

Figure 3E:
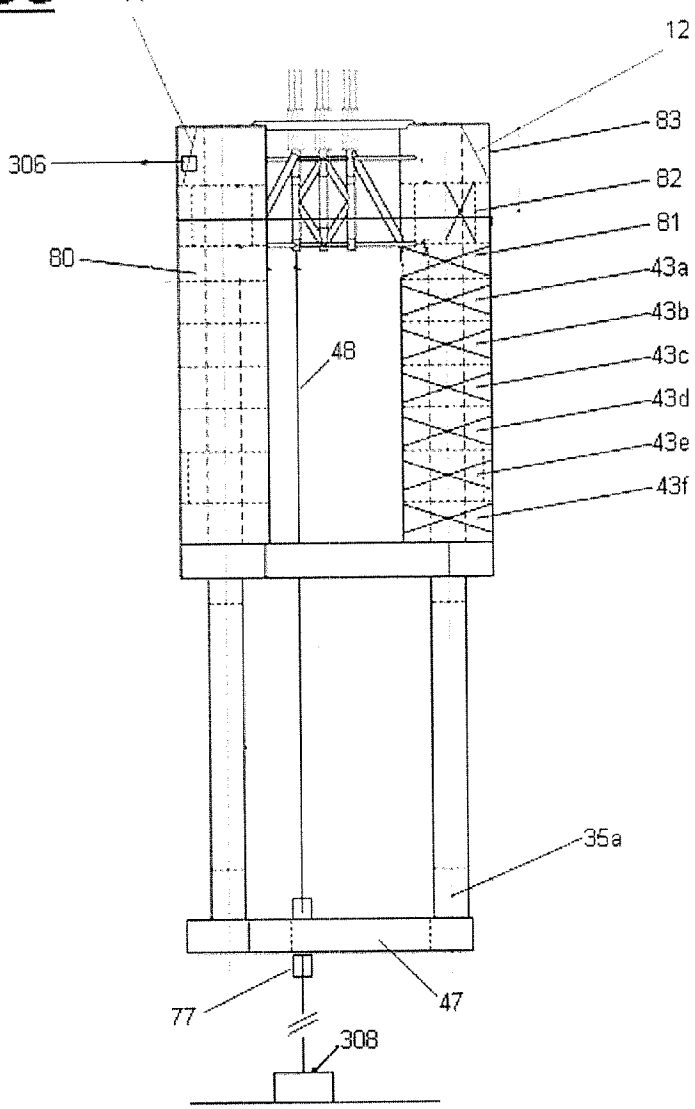
FIG. 3*e* is a representational side view of the ballast compartments used on the rig.

FIG. 3*e* illustrates a division of the column space into a plurality of inner watertight compartments that can be used to store drill water 80, potable water 81, fuel oil 82, machinery 83, and the previously mentioned ballast 43*a*, 43*b*, 43*c*, 43*d*, 43*e* and 43*f*.

FIG. 3*e* depicts the fixed ballast 47 in the lower pontoon. Fixed ballast 47 provides the rig with a pendulum stability that cannot be achieved in conventional partially submersible and buoyant or other floating units.

An auxiliary generator 306 can be built into a column of the rig so that on deballasting, the rig can be quickly started. This is a significant benefit of the present design of the rig.

Also there is contemplated herein a subsea shutoff device 308 located on the sea floor in connection with the rig for quick disconnect of the risers and moving the rig away from a subsea well. This feature is a significant safety and environmental benefit of the rig.

At least one drilling or production riser 48 extends into the space between the columns 12, 14, and 16 (not visible in this view). Riser guide 77 is depicted beneath fixed ballast 47.

The columns can be fabricated using an external shell formed into a cylindrical, or segmented shape. It is contemplated that the lower portions of the columns can have a greater wall plate thickness to withstand the water pressure in a deeper environment.

Unlike conventional partially submersible and buoyant units which simply rely upon water plane displacement for stability, or upon bottom fastened tendons, the embodied rig is stable due to the low center of gravity, resulting from deep draft and placement of solid or liquid ballast in the lower portions of the rig. The smaller cross sectional areas of the lower columns and their spacing from one another result in a substantially improved transparency and minimal response to loop current. The deep draft that places most of the rig below the water surface and into the relatively still waters at depths in excess of 500 ft. minimizes reaction to surface changes, greatly reducing heave and angular pitch of the rig.

The offshore rig can be transported to a deployment site by moving the deck separately from the buoyant columns 12, 14, and 16. The column stack can floated horizontally, with columns on their sides, and towed to the selected location under its own floatation.

Once the elements of the rig arrive at the site, the columns are ballasted, so that the lower portions of each of the columns move below the water surface to a deep draft position. The deck is then maneuvered to the top of the columns and fixedly secured, such as by welding, to the upper hulls of the columns.

Part of the ballast is then released from the columns, so that the columns move vertically to a position supporting the deck above the height of maximum wave motions for that location. Conventional techniques are then employed to lower risers and moorings to the seabed, and for flexible catenary or taut mooring of the rig at the desired location.

Once it becomes necessary to relocate the rig to another location in deep waters, risers and the mooring lines can be retrieved, and the rig call be slowly moved in a buoyant floating condition to the new location. In this manner, the cost effectiveness of the rig is significantly improved, in comparison with conventional fixed platforms, tension leg platforms, or with other rigs presently in use that do not benefit from the combined stability of the rig and the improved cost effectiveness according to the present invention.

It is envisioned that the rig can be made longer to further lower the center of gravity. Lower portions of the rig or connecting girders can be made larger to receive dense ballast and provide weight at a position in the rig close to the sea floor. Also, ballast can be made external to the columns, such as by forming large cement components and securing the blocks to the lower ends of the columns. The suspended blocks can thereby lower the center of gravity. The ballast blocks can be released in order to more easily salvage the rig at the end of its life.

The invention comprises elements that, when assembled, form a unitary integral tensioner assembly for use on a tension leg platform with a short stroke, a deep draft cassion vessel (such as a Spar™), a drill ship, a work boat, or a semisubmersible.

The tensioner assembly of the present invention may be used to replace both conventional and direct acting tensioning systems. Further variations of the tensioner assembly may be utilized in both drilling and production riser applications.

The tensioner assemblies of the present invention are operated by hydraulic fluid stroke cylinders. Lubricating fluid stored inside a low pressure secondary accumulator, which can be used to lubricate individual pistons in individual hydraulic stroke cylinders when the hydraulic stroke cylinders are energized by higher pressure compressible gas from individual primary accumulators.

The tensioner assembly is easily built with simple design parts that are easily interchangeable. There is not a need to purchase specially made parts to manufacture the tensioner assembly. The tensioner assembly additionally has only a few sealing areas, lowering the need for costly maintenance cycles, since there are fewer seals to deteriorate than conventional tensioners.

The tensioner assembly additionally has valves between the hydraulic stroke cylinders and the primary accumulator.

In one embodiment, the tensioner only uses one large primary accumulator. In another embodiment, the tensioner assembly uses two small primary accumulators connected by a valve, hereafter referred to as the first primary accumulator and the second primary accumulator connected by a valve. Any number of primary accumulators is contemplated, depending on the total volume of fluid needed to tension a riser and the available transport capacity.

The addition of the valves allow for the primary accumulators to be easily replaced by shutting off the valves without requiring disassembly of the entire tensioner assembly.

The tensioner assembly stiffness can additionally be easily adjusted. A stand pipe can be placed inside each primary accumulator allowing the altering of the volume of space inside each primary accumulator by adding fluid. The benefit of designing a primary accumulator in such a fashion is that one standard size primary accumulator can be used for a variety of applications, while having a stiffness that can be easily modified for a particular application.

The invention relates to a tensioner assembly having a fully extended position, a fully retracted position and a plurality of extended positions there between, for supporting a riser extending downwardly from a platform to a subsea wellhead.

The tensioner assembly includes a riser conductor portion for supporting a riser from a subsea well. The tensioner assembly provides upward riser support. The tensioner assembly provides riser support, particularly vertical support, when the rig is moving.

The tensioner assembly has a deck connected to a riser conductor portion. The tension disk can have a pass thru diameter from 70 inches to 36 inches, and the riser conductor portion can support risers having a diameter ranging from 21 inches to 4 inches.

A plurality of ram tensioner piston rods extend from the tensioner disk on one end and into hydraulic cylinders that are connected on one end to the lower support structure.

A cylinder deck with at least one cylinder deck hole for receiving each ram tensioner piston rod connects to the other end of the hydraulic stroke cylinders. The ram tensioner piston rods move slidingly through the cylinder deck holes, enabling the tension disk to move with the rods, away from the cylinder deck to a fully extended position, or to retract for a fully collapsed position, or any of a number of positions therebetween the fully extended and fully retracted positions.

The hydraulic stroke cylinders are secured slidingly or flexibly to the cylinder deck on one end and to the lower support structure on the opposite end.

The hydraulic stroke cylinders are disposed around the downwardly extending riser from the riser conductor portion.

A first primary accumulator engages each of the hydraulic stroke cylinders and forms a fluid communication for emitting a first pressurized gas, such as nitrogen, into the hydraulic stroke cylinder, enabling the ram tensioner piston rods to extend away from the hydraulic stroke cylinders.

A second primary accumulator can be in fluid communication with each of the first primary accumulators and hydraulic stroke cylinders for providing a continuous gas on demand to the cylinder via a manifold.

A first valve is located between each first and second primary accumulator and can be connected to control means. These valves are primarily shut off valves. They can be connected to a control means for automated shut off, but rarely to regulate.

Secondary accumulators are in fluid communication with each hydraulic stroke cylinder as well. Each secondary accumulator is generally smaller than the primary accumulators and can be secured on one end to the cylinder or cylinder deck.

Each secondary accumulator has a valve between the secondary accumulator and a hydraulic stroke cylinder. The valve can be a spring loaded dummy valve or a similar kind of valve. The valve can essentially be a poppet valve, wherein at a certain amount of pressure the valve will close. The secondary accumulator can be responsible for providing a fluid for lubricating the hydraulic stroke cylinder.

FIG. 3*d* depicts a side view of three tensioner assemblies 20*a*, 20*b*,20*c*. In this Figure, the conductors 62*a*, 62*b*, and 62*c* are each connected to a cylinder deck 121.

The tension disks supports between four and twelve ram tensioner piston rods.

In the embodiment of FIG. 3*d*, only 4 such ram tensioner rods are contemplated per tensioner assembly.

The rain tensioner piston rods slide through a cylinder deck 121*a*, 121*b*, and 121*c*. Each tensioner assembly has a cylinder deck 121*a*, 121*b* and 121*c*, wherein each cylinder deck having at least 4 holes, one for enabling each piston rod to slide through the cylinder deck 121. Each tension assembly has a tension disk 112*a*, 112*b*, and 112*c*.

Secured to the deck opposite where the ram tensioner piston rods 114 and 120 are connected corresponding hydraulic stroke cylinders.

Figure 4:
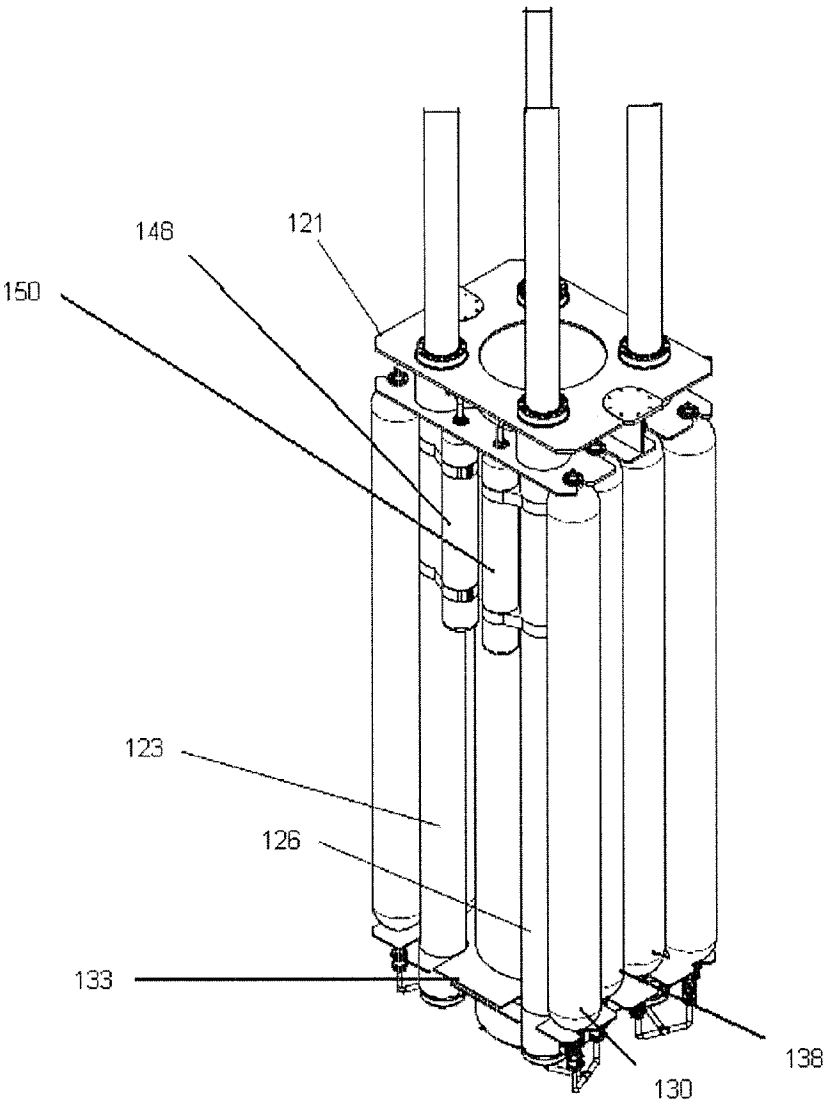
FIG. 4 is a perspective view of a tensioner assembly.

FIG. 4 provides a perspective view of the hydraulic stroke cylinders are contemplated in this embodiment, and two are shown in the view, namely, first hydraulic stroke cylinder 123 and third hydraulic stroke cylinder 126.

Each hydraulic stroke cylinder is contemplated to support a pressure ranging from 15 psi to 4000 psi.

Each hydraulic stroke cylinder is contemplated to use a lubricating fluid such as water based glycol type mixturex, a hydraulic oil, white oil, peanut oil, environmentally friendly oils or fluids that pass the United States Environmental Protection Agency "shrimp test" for non-toxic lubricants, or other types of lubricating fluids.

The hydraulic stroke cylinders are supported on the ends between the cylinder deck 121 and a lower support structure 133.

The lower support structure 133 not only supports each of the hydraulic stroke cylinders, including cylinders 123 and 126, as shown, but also supports a plurality of primary accumulators, each primary accumulator in direct fluid communication with one of the hydraulic stroke cylinders.

In this view a first primary accumulator 130 is shown connected to the lower support structure 133. A second primary accumulator 138 is also shown in this embodiment, connected to lower support structure 133. The first primary accumulator 130 and second primary accumulator 138 provides ga or other compressible fluid to the hydraulic stroke cylinder 126. For a dual primary accumulator embodiment, the sum of the volume of the first primary accumulator and that of the second primary accumulator provide the stiffness needed for the system. The size of the volume of the primary accumulators is based on a calculation of the stiffness of the system, which can range from 1.5 percent to 14 percent of the tension setting per foot.

A first secondary accumulator 148 and a second secondary accumulator 150 are depicted in FIG. 4. The first secondary accumulator 148 is in communication with hydraulic stroke cylinder 123 and the second secondary accumulator 150 is in communication with hydraulic stroke cylinder 126. First secondary accumulator 148 contains a lubricating fluid for lubricating hydraulic stroke cylinder 123. Second secondary accumulator contains a lubricating fluid for lubricating hydraulic stroke cylinder 126.

It is contemplated that the compressible fluids may all be the same in each of the primary accumulators and the lubricating fluids may all be the same in the secondary accumulators. It is also contemplated, however, that the fluids can differ.

Figure 5:
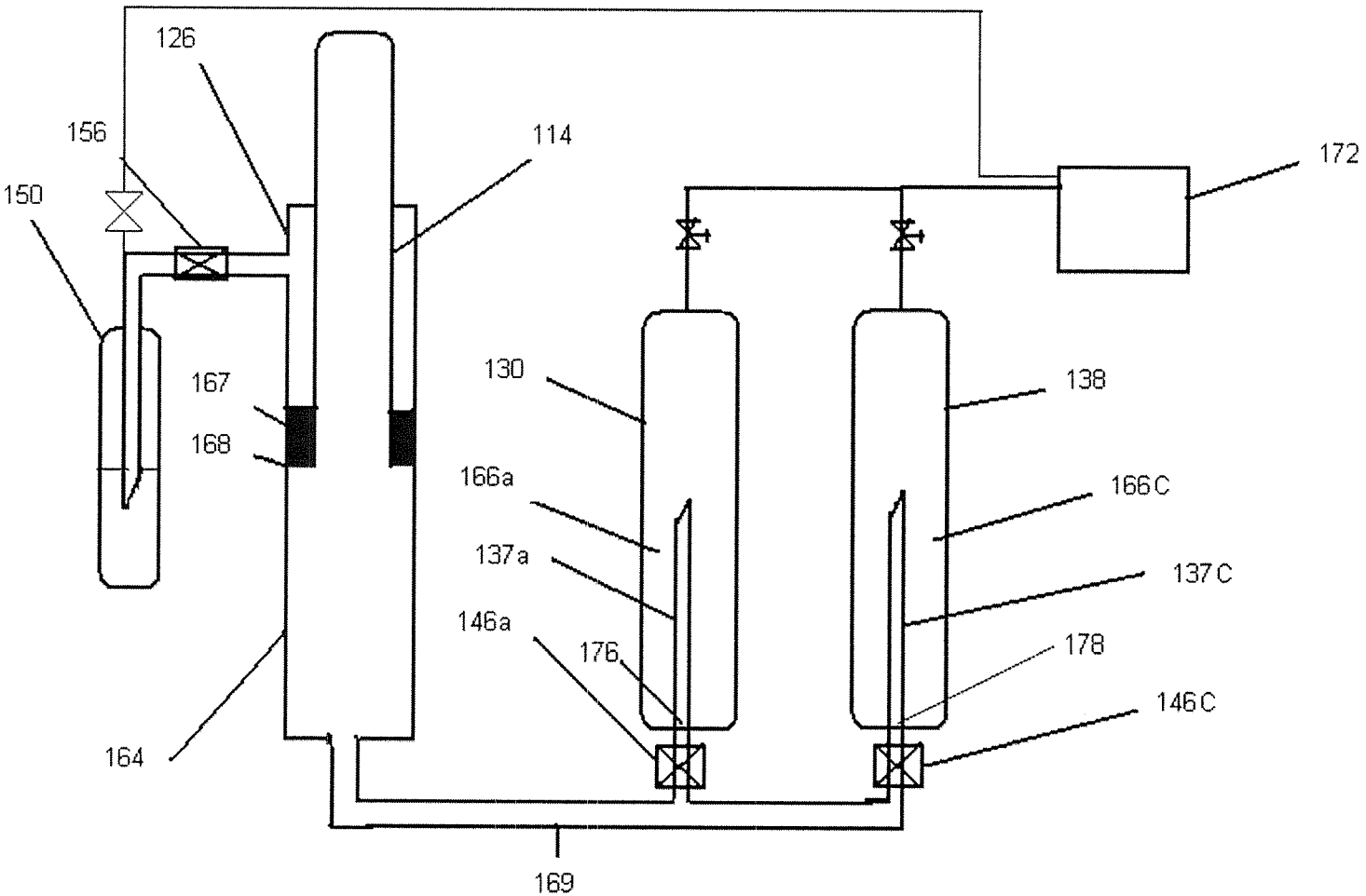
FIG. 5 is a schematic cross sectional view of a tensioner assembly.

FIG. 5 is a schematic representation of the tensioner assembly. In this view, a plurality of ports are preferably located on the bottom of each of the first primary accumulator 130 and the second primary accumulator 138 for flowing pressurized gas to the hydraulic stroke cylinders. Also depicted in this figure are first port 176 and second port 178.

Shut off valves 146*a* and 146*c* are located between the primary accumulators 130 and 138 and a manifold 169 for flowing compressible gas to a hydraulic stroke cylinder 126. A bore 164 is shown for receiving the compressible fluid or gas, such as nitrogen 166*a* and 166*c* from the primary accumulators 130 and 138. The piston 167 is shown with a seal 168. A first ram tensioner rod 114 engages the hydraulic stroke cylinder 126. A speed control valve 156, that can also be a poppet valve, is located between the hydraulic stroke cylinder and a secondary accumulator 150. A control means 172 is used to control the gas and fluid flows from the accumulators. The control means 172 can be an automated or manual system.

Inside each primary accumulator is depicted a stand pipe 137*a* and 137*c*. The stand pipes 137*a* and 137*c* are used to allow fluid adjustment by the accumulators to increase the stiffness of the tensioner assembly. The presence of stand pipes 137*a* and 137*c* allow each primary accumulator to be filled to control the volume within each primary accumulator, thereby affecting the stiffness of the tensioner assembly.

Figure 6:
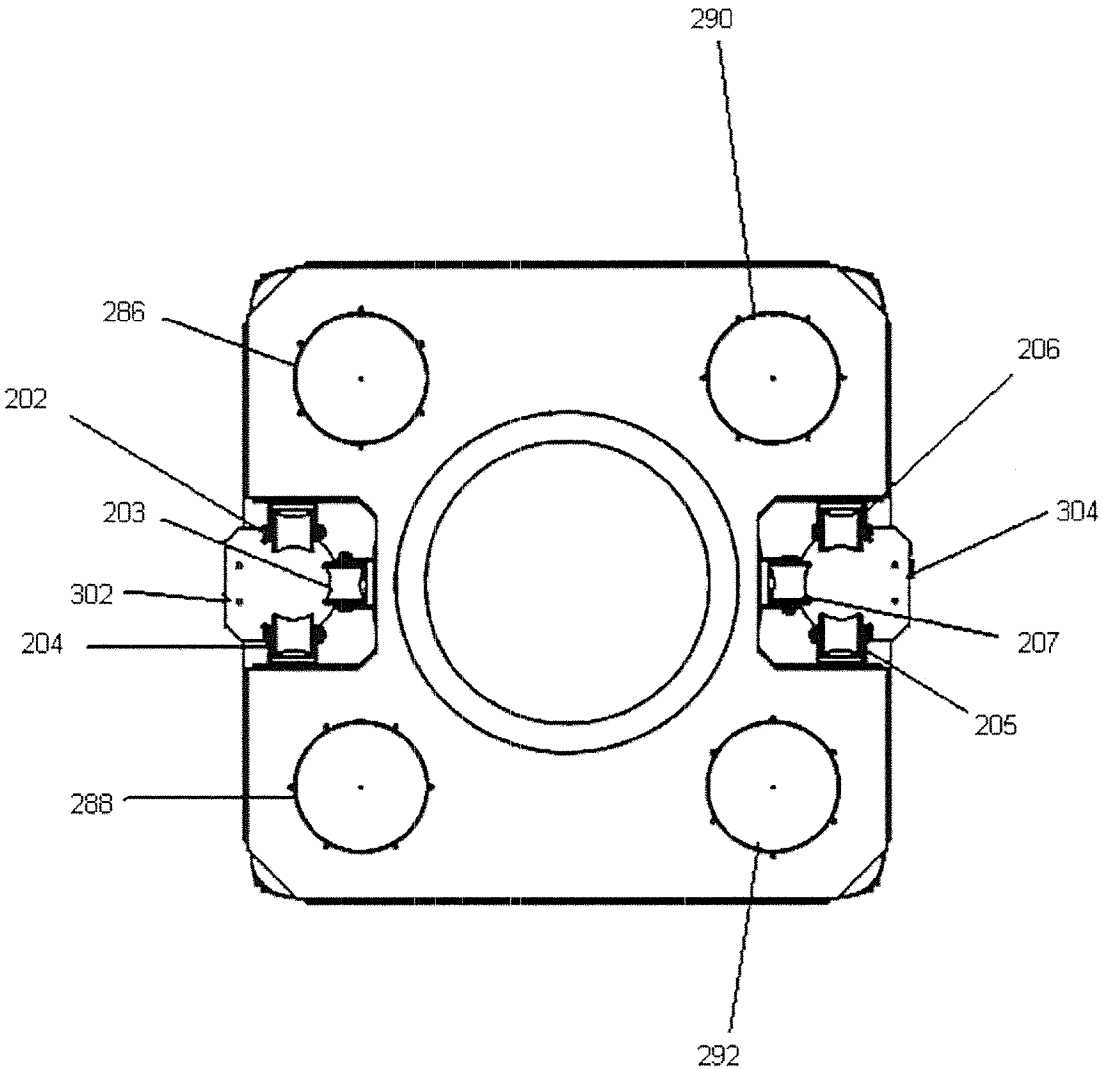
FIG. 6 is a top view of the tensioner assembly.

FIG. 6 depicts a top view of the tensioner assembly. FIG. 6 shows first rollers 202, 203, and 204 for engaging a track 302, and a second group of first rollers 205, 206, and 207 for engaging a second track 304 on a side of the tensioner assembly opposite the first track 302.

FIG. 6 also shows four fasteners 286, 288, 290, and 292, for supporting the ram tension piston rods. Fasteners 286, 288, 290, and 292 are depicted in a square orientation, each fastener at a corner of the tension disk. The fasteners can be a cylinder rod receptacle for receiving a cylinder rod from the cylinder deck.

Figure 7:
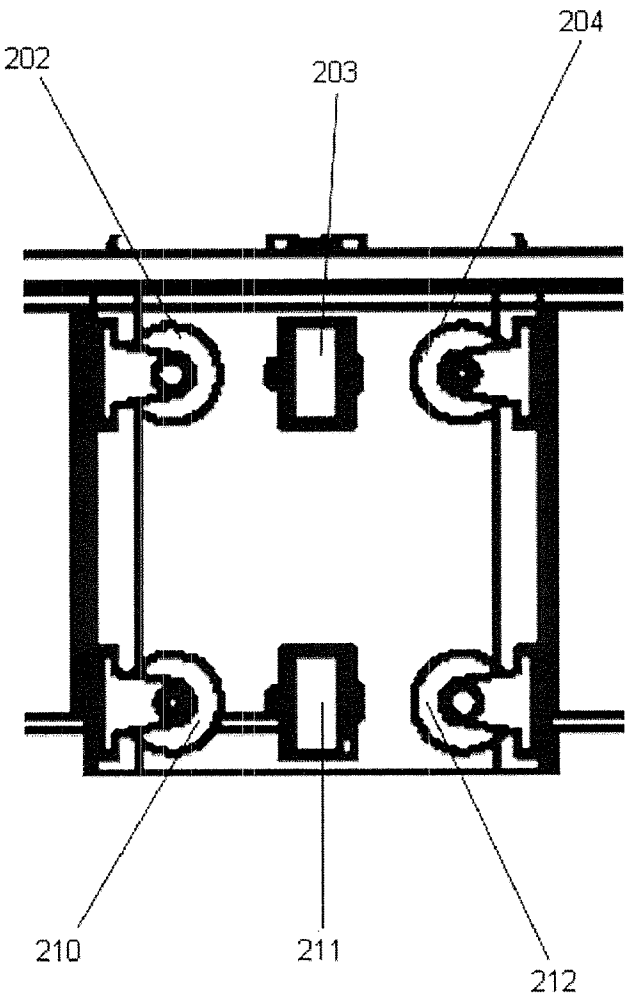
FIG. 7 is a detailed side view of the rollers of the tensioner assembly.

FIG. 7 depicts a side view of the rollers of the tensioner assembly. FIG. 7 shows a second set of rollers 210, 211, and 212 that can be located beneath the first set of rollers 202, 203, and 204 for enhanced stability and resistance to eccentric load, sway, yaw, and pitch.

It is contemplated that the rollers can grab the track on three sides for enhanced security and significant reduction of lateral movement and stability of the tensioner assembly. This flexibility combined with security is a significant feature of this design.

Figure 8:
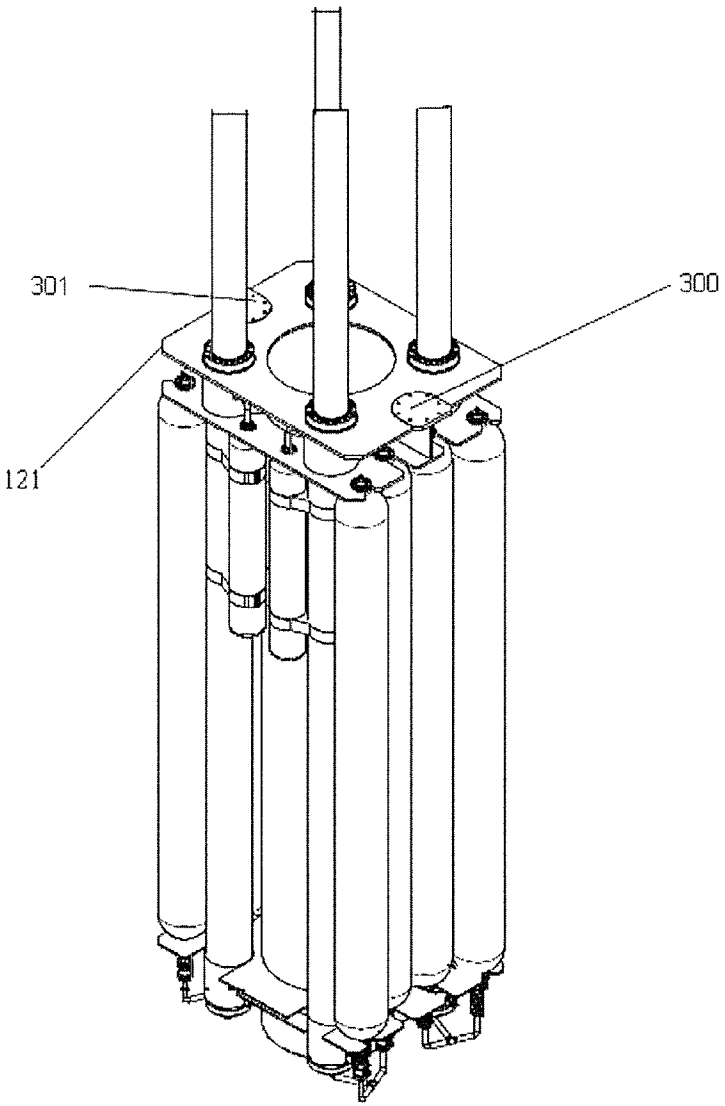
FIG. 8 is a partial top perspective view of the tensioner assembly.

FIG. 8 shows first track mounting base 300 and second track mounting base 301 for securing the track to the cylinder deck 121.

Figure 9:
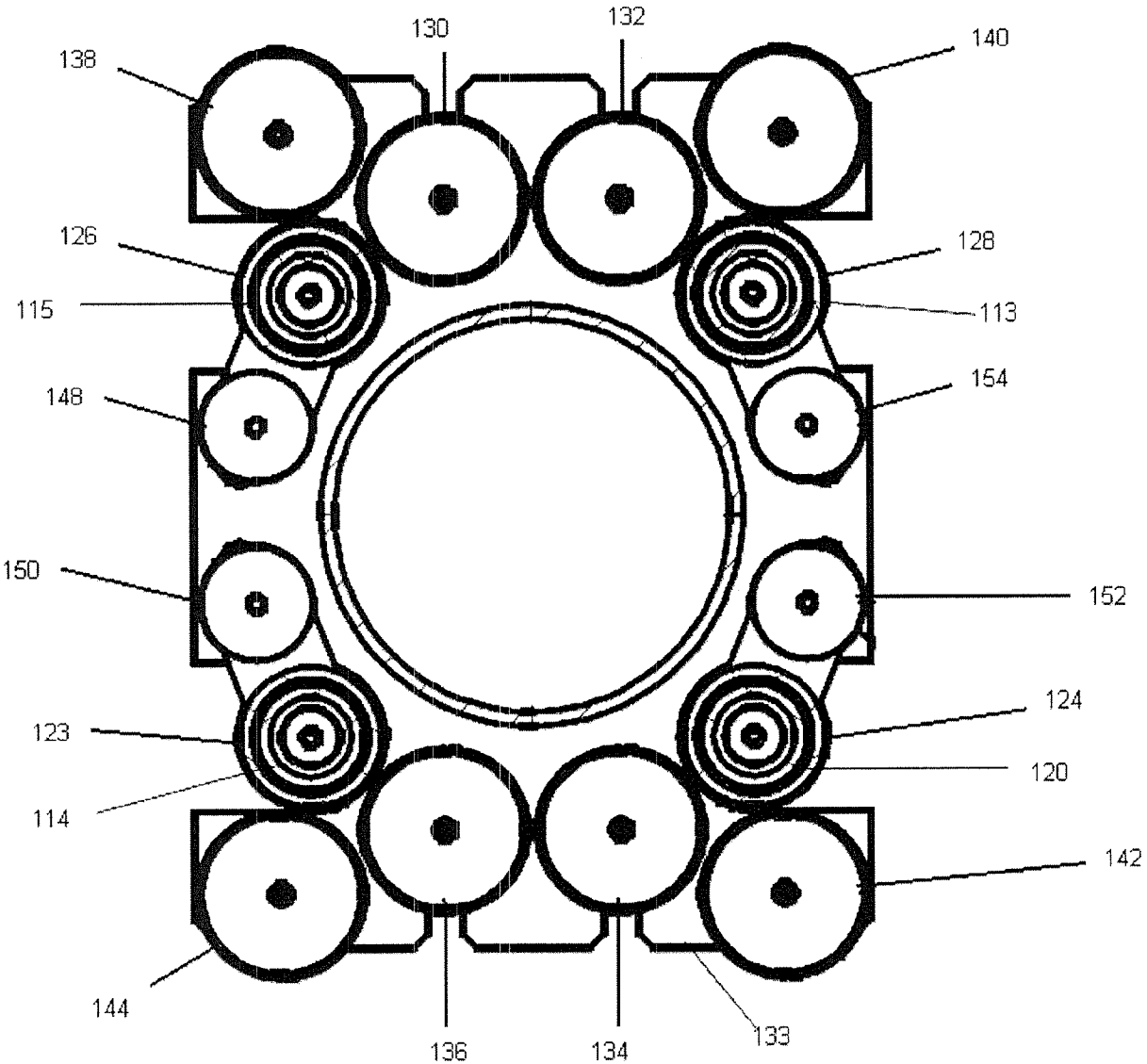
FIG. 9 is a top view of a cross section of the tensioner assembly.

FIG. 9 depicts a top view of an embodiment of the tensioner assembly having two primary accumulators servicing each of the hydraulic stroke cylinders. There is shown first hydraulic stroke cylinder 123, second hydraulic stroke cylinder 124, third hydraulic stroke cylinder 126, and fourth hydraulic stroke cylinder 128.

First Primary accumulators 130, 132, 134 and 136 are shown. First primary accumulator 130 is in communication with ram tensioner piston rod 115. First primary accumulator 132 is in communication with ram tensioner piston rod 113. First primary accumulator 134 is in communication with ram tensioner piston rod 120. First primary accumulator 136 is in communication with ram tensioner piston rod 114.

Second primary accumulators 138, 140, 142 and 144 are shown on the lower support structure 133. Second primary accumulator 138 is in communication with ram tensioner piston rod 115. Second primary accumulator 140 is in communication with ram tensioner piston rod 113. Second primary accumulator 142 is in communication with ram tensioner piston rod 120. Second primary accumulator 144 is in communication with ram tensioner piston rod 114.

Secondary accumulator 148 engages hydraulic stroke cylinder 126. Secondary accumulator 150 engages hydraulic stroke cylinder 123. Secondary accumulator 152 engages hydraulic stroke cylinder 124. Secondary accumulator 154 engages hydraulic stroke cylinder 128.

It should be noted that certain materials are contemplated for use herein, including carbon steel, stainless steel, aluminum and titanium. It is contemplated that the ram tensioner piston rods and hydraulic stroke cylinders can be made form a light weight material that helps to reduce the overall weight of the tensioner assembly and helps to eliminate friction.

It is contemplated that the assembly can be designed to reduce the potential for electrolysis and galvanic action causing corrosion.

The tensioner with the conductor can be secured to the cylinder deck, enabling the riser to travel safely within the conductor, while providing stability from waves and other waterline movement of the vessel, such as yaw, pitch and sway. The conductor is contained within the center of the tensioner and is surrounded by the cylinders and accumulators.

The conductor extends below the water line of the rig and can be made from steel, aluminum, graphite, composite, or concrete.

In operation, the tensioner disk moves up and down along the track that is secured to the cylinder deck and production platform, along rollers that can be hard rubber, metal wheels, or a composite material over a stiff core. The rollers can also be steel, nylon, polyurethane, or composites of steel and nylon. The use of at least three wheels is contemplated per track. The wheels can be positioned in a T configuration. It is also contemplated that six wheels per track, or up to nine wheels per track can be used.

It should be noted that the moveable slidable assembly of the tensioner can be a plurality of rollers or wear pads, or bushings.

The tensioner assembly of the present invention may be utilized to compensate for offset of an oil drilling vessel connected to a riser. For example, the tensioner assembly can be placed or disposed in communication with an oil production or drilling vessel and the riser which extends through the ocean from a subsea well.

It is to be understood that the invention is not limited to the exact details of construction, operation, exact materials or embodiments shown and described as obvious modifications and equivalents will be apparent to one skilled in the art. For example, the piston could include only one port, and the valves can be one of several different types of valves. Also the tensioner assembly may be assembled using bolts, welding, or using any other device or method known to persons of ordinary skill in the art. Moreover, the individual components may be manufactured out of any material and through any method known to persons of ordinary skill in the art, though steel is the preferred material and nitrogen is a preferred gas.

While these embodiments have been described with emphasis on the embodiments, it should be understood that within the scope of the appended claims, the embodiments might be practiced other than as specifically described herein.

Many other changes and modifications can be made in the design of the present invention without departing from the spirit thereof.

What is claimed is:

1. A deep draft partially submersible and buoyant floating vessel, comprising:

at least three independent vertical columns, each of the at least three independent vertical columns comprising:

a. an upper column with an upper column diameter and an upper column variable ballast means;

b. a lower column integrally connected to the upper column having at least one ballast means;

a lower pontoon connected to each lower column comprising lower pontoon fixed ballast means;

an upper pontoon connected to each upper column and each lower column of each of the at least three independent vertical columns;

at least one deck suitable for conducting afloat operations, wherein the at least three independent vertical columns are spaced from each other to provide transparency for damping wave induced motions of the vessel and all of the ballast means accommodating eccentricities acting on the deck or an operational loads to prevent mutual load transfer between the at least three independent vertical columns using a plurality of horizontal braces;

a ring frame with a plurality of vertical stiffeners secured to an inner circumference of each of the at least three independent vertical columns;

a tensioner assembly secured to the vessel;

wherein the spacing of the columns provides sufficient water plane inertia; and a center of gravity is maintained below a center of buoyancy of the vessel.

2. The vessel of claim 1, wherein the ring frame is positioned within an outer shell of each column and the vertical stiffeners are secured in an annular space between the ring frame and an inner wall of the outer shell.

3. The vessel of claim 1, wherein the tensioner assembly comprises:

a. a riser support ring for supporting a riser;

b. a tensioner disk connected to the riser Support ring having a moveable slidable assembly for engaging a first track and a second track;

c. a lower support structure for slidably and laterally supporting the riser;

d. a plurality of ram tensioner piston rods for engaging the tensioner disk on one end;

e. a cylinder deck;

f. a plurality of hydraulic stroke cylinders, secured on one end to the cylinder deck and on the other end to the lower support structure, wherein each of the plurality of hydraulic stroke cylinders receives one of the plurality of ram tensioner piston rods;

g. a plurality of primary compressible fluid accumulators, wherein each of the plurality of primary compressible fluid accumulators is in fluid communication with one of the plurality of hydraulic stroke cylinders;

h. a plurality of secondary non-compressible fluid accumulators, wherein each of the plurality of secondary non-compressible fluid accumulators is in fluid communication with one of the plurality of hydraulic stroke cylinders;

i. a conductor secured to the lower support structure for slidably and removably containing the riser from a subsea well, and wherein the tensioner disk can move from a fully retracted position to a fully extended position and a plurality of positions therebetween using the moveable slidable assembly to engage the first track and the second track preventing lateral movement of the tensioner assembly due to yaw, roll, and sway of the vessel.

4. The vessel of claim 1, wherein an auxiliary generator is built into at least one of the at least three independent vertical columns.

5. The vessel of claim 1, wherein a subsea shutoff device is located on a sea floor in connection with the vessel for quickly disconnecting the riser and moving the vessel away from a subsea well.

6. The vessel of claim 3, wherein at least two primary compressible fluid accumulators are in fluid communication with one of the plurality of hydraulic stroke cylinders.

7. The vessel of claim 6, wherein at least one valve flows fluid from the at least two primary compressible fluid accumulators to the one of the plurality of hydraulic stroke cylinders.

8. The vessel of claim 7, wherein the valve is a block valve or shut off valve.

9. The vessel of claim 3, wherein the moveable slidable assembly comprises a plurality of rollers, a plurality of wear pads, a plurality of bushings, or combinations thereof.

10. The vessel of claim 3, wherein the conductor extends below a water line of the vessel and comprises a member of the group consisting of: steel, aluminum, graphite, composite, concrete, or combinations thereof.

11. The vessel of claim 1 wherein the vessel further comprises a production module, a utility module, or combinations thereof disposed on the vessel.

12. The vessel of claim 1, wherein at least one non-buoyant plate comprising a central hole is connected between each lower pontoon.

13. The vessel of claim 1, wherein at least one non-buoyant plate comprising a central hole is connected between each upper pontoon.

14. The vessel of claim 3, wherein each of the plurality of ram tensioner piston rods are in a flexible engagement with one of the plurality of hydraulic stroke cylinders.

15. The vessel of claim 3, wherein each of the plurality of ram tensioner piston rods are in a sliding engagement with one of the plurality of hydraulic stroke cylinders.

* * * * *